United States Patent [19]

Tsai

[11] 4,265,402

[45] May 5, 1981

[54] STROBED LIQUID DISPLAY DEVICE AND HEAD THEREFOR

[76] Inventor: Wen-Ying Tsai, 154 Hester St., New York, N.Y. 10013

[21] Appl. No.: 57,340

[22] Filed: Jul. 13, 1979

[51] Int. Cl.[3] ..... F21P 7/00

[52] U.S. Cl. ..... 239/20; 40/406; 239/23; 239/102; 239/558; 272/8 P

[58] Field of Search ..... 239/17, 18, 20, 23, 239/102, 140, 225, 264, 558; 40/406, 407, 409, 439; 272/8 R, 8 D, 8 P, 27 R

[56] References Cited

U.S. PATENT DOCUMENTS

| | | | |
|---|---|---|---|
| 1,195,686 | 8/1916 | Kelly | 239/558 |
| 1,977,997 | 10/1934 | Patterson | 239/16 |
| 3,337,133 | 8/1967 | Duerkob | 239/18 |
| 3,387,782 | 6/1968 | Mizuno | 239/20 |
| 3,432,099 | 3/1969 | Boniecki et al. | 239/18 |
| 3,455,509 | 7/1969 | Balkin | 239/18 |
| 3,560,641 | 2/1971 | Taylor et al. | 40/406 |
| 3,568,927 | 3/1971 | Scurlock | 239/18 |
| 3,717,945 | 2/1973 | Taylor et al. | 40/409 |
| 3,838,816 | 10/1974 | Huff et al. | 239/18 |
| 3,924,808 | 12/1975 | Cooley, Jr. | 239/102 |

*Primary Examiner*—Bruce H. Stoner, Jr.
*Assistant Examiner*—Michael J. Forman
*Attorney, Agent, or Firm*—Hubbell, Cohen, Stiefel & Gross

[57] ABSTRACT

A head (12) for incorporation in a strobed liquid display is disclosed. The head comprises a housing (30) defining a chamber (38), the housing (30) having an inlet opening (39) for connection to a liquid supply, a top wall (32) having a vent (42), a bottom wall (34) having a plurality of apertures (44) spaced from and distributed about the center thereof for accommodating the outflow of liquid droplets from the chamber (38), and a sidewall (36) extending between the top and bottom walls (32, (34). The head (12) also includes a vibrating device rigidly connected to the housing (30) for imparting a periodic wobble thereto for dispensing the droplets through the apertures (44) in sequential fashion with substantially uniform spacing between successive droplets dispensed through each aperture (44), whereby the dispensed droplets substantially define a helix. A strobe liquid display system (10) incorporating the head (12) is also disclosed.

19 Claims, 6 Drawing Figures

STROBED LIQUID DISPLAY DEVICE AND HEAD THEREFOR

BACKGROUND OF THE INVENTION

1. Field of the Invention

This invention pertains generally to display devices and more particularly to such devices wherein the visual effect is created, at least in part, by liquid movement. Most particularly, this invention pertains to such devices wherein the moving liquid is intermittently illuminated, as by a strobe.

2. Statement of the Prior Art

Strobed water displays are known. The displays disclosed in U.S. Pat. No. 3,387,782 issued to Mizuno are exemplary. In one display embodiment disclosed in that patent, water from a catch basin is pumped out through jet nozzles distributed along an annular pipe. The annular pipe and jet nozzles are rotated by a pulley with the result that the streams of water emitted from the jet nozzles form a cylindrical water screen. The water screen is illuminated by one or more strobolights which, according to the patent, give the water screen the appearance of having crossing tracks. As disclosed in the patent, the visual effect of the device results from adjusting the strobe rate to at or near multiples of the rotation rate whereby the stream of water ejected from each jet nozzle is illuminated at substantially the same location in space upon each rotation of the annular pipe.

In a variation disclosed in Mizuno's patent, a single stream of water is broken into droplets which are emitted from a jet nozzle at or near a constant period of pulsation. According to the patent, the period of pulsation may be regulated by, for example, a vibrator. The resulting stream of droplets is illuminated by a strobolight. As disclosed in the patent, when the strobe rate is substantially the same as the period between droplets, the droplet stream appears motionless. When the strobe rate is varied from the pulsation period, the droplets will appear to rise or fall. Thus, unlike Mizuno's embodiment discussed above, wherein the visual effect is created by adjusting the strobe rate relative to the period of rotation of one or more streams of water, the visual effect of this embodiment is created by adjusting the strobe rate relative to the spacing between droplets in a single stream of water.

Other lighted water displays are disclosed in U.S. Pat. Nos. 3,337,113, 3,383,816, 3,568,927, 3,455,509 and 3,432,099. However, none of the displays disclosed in these patents is strobed. U.S. Pat. No. 1,977,997 dislcoses the concept of utilizing sound to regulate flow through a fountain.

SUMMARY OF THE INVENTION

According to the present invention, I have developed a novel stobed display device which includes a novel head capable of generating a plurality of liquid streams having substantially equally spaced droplets. The liquid streams emanating from the head are intermittently illuminated, as by a strobe or similar device, the strobe rate being at or near the pulsation rate or multiples thereof. The result is a unique and pleasing visual effect. Specifically, if the streams are strobed at a rate equal to the pulsation rate, all the water droplets appear to be standing still in space. If the strobe rate is increased above or below the pulsation rate, the water droplets appear to rise or fall, respectively.

The preferred head includes a hollow disc defining an internal chamber. The bottom wall of the disc is provided with a plurality of apertures preferably distributed in concentric circles at or near the periphery of the disc. Water is fed into the chamber through an opening in the top wall of the disc and an additional opening is provided in the top wall to serve as a vent. The disc is secured, as by suitable brackets, to one end of the casing of a preferably synchronous motor which has a weighted member secured to its shaft off center of the shaft axis. The other end of the motor casing is secured to a conventional vibration mounting which, in turn, is secured to a stationary support, such as a ceiling.

It will therefore be apparent that as the motor rotates, the weighted member imparts a periodic "wobble" to the head which is accommodated by the vibration mounting. As a result, water droplets fall through the apertures in the bottom wall of the disc in equally spaced intervals determined by the rotation rate of the motor. Because the wobble imparted to the head by the weighted member results in a droplet leaving each successive aperture at a slightly different time, the droplets, when strobed, collectively present a helical pattern. Preferably, the motor speed is 1,800 rpm and the strobe rate is at or near 1,800 cpm.

In a preferred embodiment of my display device, the water leaving the head is collected in a trough therebeneath and recirculated to the head as by a submersible pump. Alternatively, the head could be directly connected to an "endless" source of water as by connecting the head to a water faucet. Also preferred is the use of a controller to vary the strobe rate in response to an audio signal. This is preferred as it results in continual changes in the visual effect. That is, the helical pattern will appear to rise, fall, or remain motionless depending upon the audio input to the controller.

Further features and advantages of the preferred display device and variations thereof will be more fully apparent from the following detailed description and annexed drawings.

DETAILED DESCRIPTION OF THE PREFERRED EMBODIMENT

Figure 1:
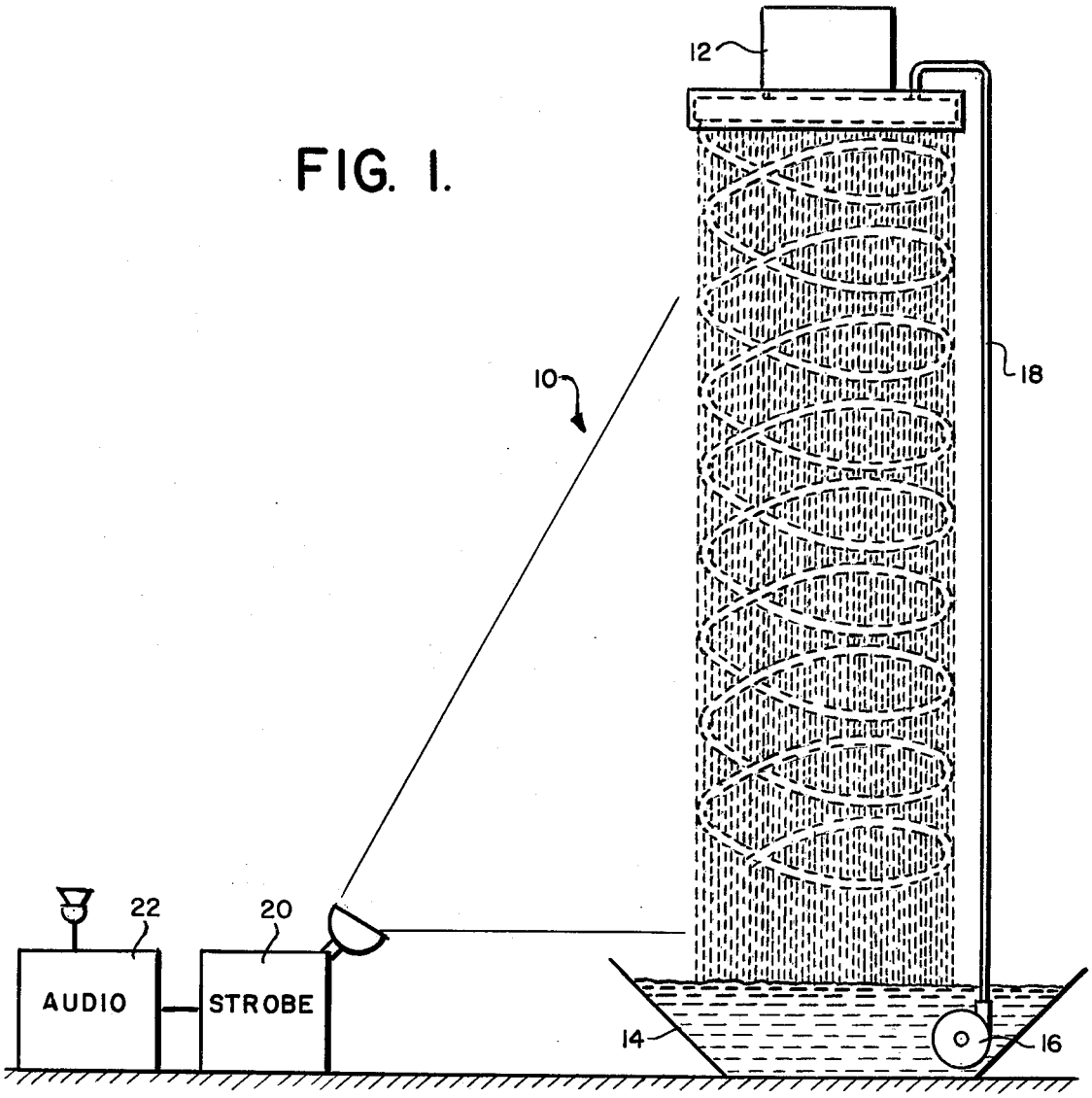
FIG. 1 is a partially elevational, partially diagrammatic illustration of the preferred display device in accordance with the present invention.

Referring initially to FIG. 1, a preferred display device according to the present invention is generally designated by the reference numeral 10. Preferred display 10 includes a head 12, a trough 14, a submersible pump 16, a return line 18, a strobe 20 and a controller 22.

Figure 2:
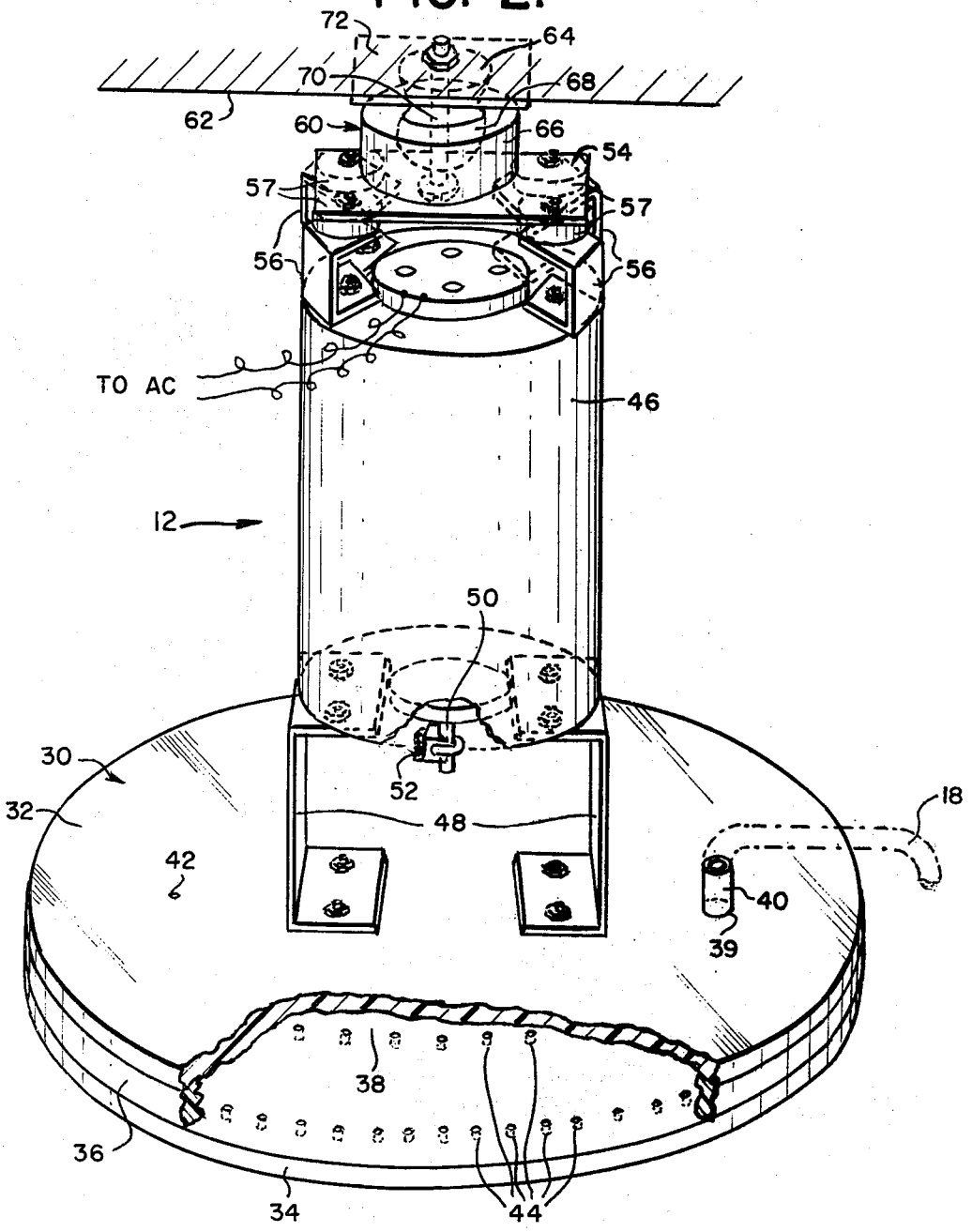
FIG. 2 is a perspective view of the head incorporated in the display device of FIG. 1.

The preferred head 12 is best illustrated in FIG. 2. As shown, head 12 includes a hollow disc-shaped housing 30 comprised of top and bottom walls 32 and 34, respectively, and annular peripheral side wall 36. The housing 30 defines a chamber 38 which communicates with line 18 through an inlet opening 39 in top wall 32. The inlet opening is preferably surrounded by an upstanding rigid tubular member 40 to facilitate connection to supply line 18. Top wall 32 is also preferably provided with a vent opening 42. The bottom wall 34 of housing 30 is provided with a plurality of outlet apertures 44 which accommodate the outflow of water from chamber 38. As presently preferred and shown, apertures 44 are arranged in two concentric circles adjacent the periphery of the housing 30 with the apertures 44 in each circle being equidistant from each other. As this description progresses, those skilled in the art will appreciate that housing 30 may be comprised of any suitable material. However, clear plastic is presently preferred, with the walls 32, 34 and 36 being separately formed and joined together as by a suitable adhesive.

Preferred head 12 also includes a motor 46 secured at one end to housing 30 as by confronting C-shaped brackets 48. For reasons that will be apparent hereinafter, a weighted member or eccentric 52 is secured to shaft 50 of motor 46 off center of the shaft axis. Motor 46 is secured at its other end to a support plate 54 as by four additional C-shaped brackets 56. Preferably, rubber discs 57 are secured between brackets 56 and support plate 54. The reason for this will be explained herinafter. Support plate 54 is, in turn, secured to a conventional vibration mounting 60 which is secured to an immovable support, such as the ceiling 62. Preferred vibration mounting 60 comprises mating steel members 64, 66 separated by a rubber seat 68 and joined together by bolt 70. Desirably, bolt 70 is secured to ceiling 62 through a metal plate 72 which provides additional structural support. As will be more fully explained hereinafter, vibration mounting 60 serves to accommodate movement of the head 12 relative to ceiling 62.

Any suitable motor 46 may be incorporated in head 12. However, I presently prefer to employ a synchronous motor since, as will be apparent hereinafter, the visual effect created by the display 10 is best when the rotation rate of shaft 50 is constant. Synchronous motors manufactured by the Bodine Electric Company, Chicago, Ill. are suitable. For my purposes, a synchronous motor having a motor speed of 1800 rpm is presently preferred.

Figure 3:
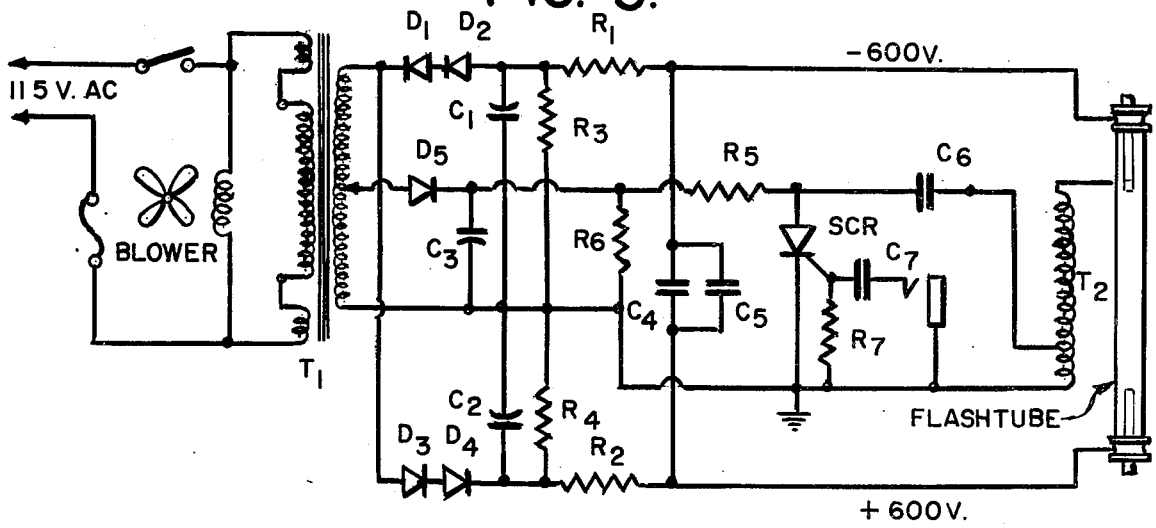
FIG. 3 is a schematic representation of the preferred circuit for the strobe incorporated in the display device of FIG. 1.

Likewise, strobe 20 may comprise any of numerous commercially available strobes. However, I prefer to use a strobe unit which I have specifically designed for use in display device 10. A circuit for the preferred strobe unit 20 is shown in FIG. 3, wherein the preferred circuit components are:

| Component | Value or Manufacturer's Designation |
|---|---|
| C1, C2 | 16uf, 600v |
| C3 | 16uf, 400v |
| C4, C5 | 0.5uf, 1500v |
| C6 | 0.15uf, 400v |
| C7 | 0.05uf, 400v |
| R1, R2 | 2500, 15 watt |
| R3, R4 | 1 Megohm, 1 watt |
| R5 | 10K, 7 watt |
| R6 | 220K, 1 watt |
| R7 | 2.7K, ¼ watt |
| D1-D5 | Type IN4007 |
| Blower | Howard Industries Type 3-90-8528 |

-continued

| Component | Value or Manufacturer's Designation |
|---|---|
| Fuse | AGC3 - 3 ampere |
| Flashtube | E.G.&G. Inc. Type Fx-38-C3 |
| SCR | Motorola Type 2N4443 |
| T1 | Triad Transformer R-10 |
| T2 | E.G. & G. Inc. Tr-132 |

Figure 4:
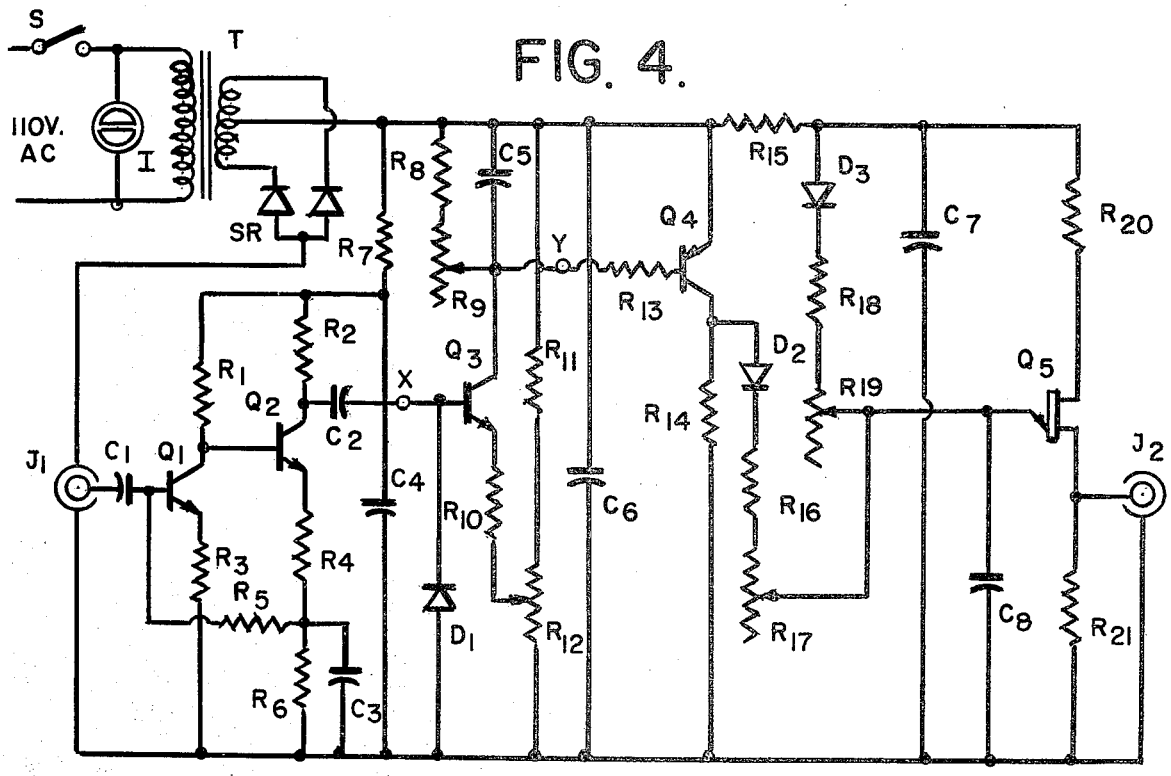
FIG. 4 is a schematic representation of the preferred circuit for the controller incorporated in the display device of FIG. 1.

For reasons that will be apparent hereinafter, I prefer to use a controller 22 for varying the rate of strobe 20. The controller 22 varies the strobe rate in response to audio input signals, the amount of variation being dependent on the magnitude of the signal. While various circuits may be used for this purpose, I have designed the circuit shown in FIG. 4 which I prefer to use. The preferred circuit components for the controller 22 are:

| Component | Value or Manufacturer's Designation |
|---|---|
| C1 | 2uf, 10v |
| C2 | 1uf, 25v |
| C3 | 100uf, 6v |
| C4, C7 | 100uf, 25v |
| C5 | 4.7uf, 25v |
| C6 | 500uf, 25v |
| C8 | .47uf, 15v-10% |
| D1-D3 | 1N682 |
| Q1-Q3 | 2N2923 |
| Q4 | 2N3905 |
| Q5 | 2N2646 |
| R1, R8 | 68K |
| R2 | 10K |
| R3 | 330 |
| R4 | 82 |
| R5 | 180K |
| R6, R7, R15 | 1K |
| R9 | 250K pot. |
| R10, R21 | 100 |
| R11 | 1.6K |
| R12 | 1K pot. |
| R13 | 470K |
| R14, R16 | 13K |
| R17, R19 | 100K trimmer |
| R18 | 47K |
| R20 | 750 |
| SR | Rectifier 75v, 100mA |
| T | 32VCT, 40mA |
| I | 110v neon indicator |
| J1, J2 | RCA phono jack |
| MIC | High-Z Dynamic microphone |

Figure 5:
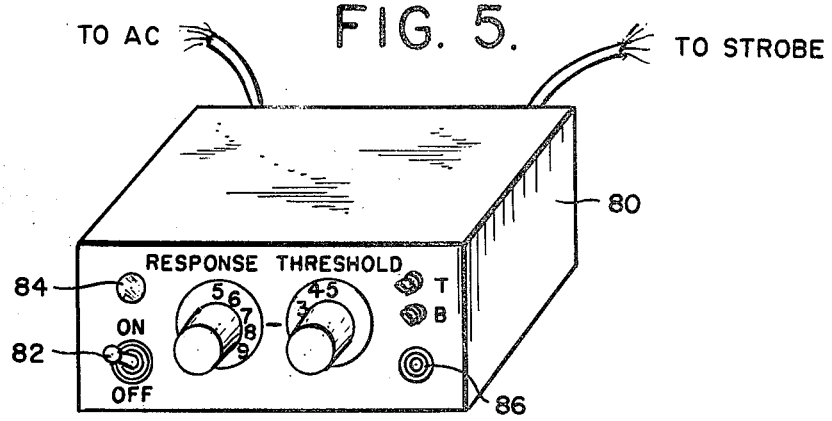
FIG. 5 is a perspective view of the preferred housing for the controller circuit illustrated in FIG. 4.

Referring to FIG. 5, controller 22 may be housed in a utility box 80 provided with suitable external controls. The knob labeled RESPONSE in FIG. 5 varies resistor R9 in FIG. 4. Resistor R9 controls the time lapse between input of an audio signal to controller 22 and the generation of a control signal at the output. The knob marked THRESHOLD varies the resistor R12 in FIG. 4 which sets the minimum audio amplitude capable of eliciting a response. The screw adjustment marked "T" varies the resistor R17 which sets an upper limit on the strobe rate. The screw adjustment marked "B" varies the resistor R19 which sets a minimum strobe rate. Also shown on the front panel of utility box 80 are on-off switch 82 (S in FIG. 4), the pilot light 84 for indicating when unit 22 is ON (I in FIG. 4), and microphone jack 86 (J1 in FIG. 4). Preferably, a jack (J2 in FIG. 4) suitable for connection to strobe 20 is located on the back of the box 80.

Referring again to FIGS. 1 and 2, in operation, trough 14 is filled and submersible pump 16, strobe 20, controller 22 and motor 46 are activated by connection to a suitable AC power source. As pump 16 pumps water from trough 14 through line 18 into chamber 38, air in the chamber is forced out through the vent 42 until chamber 38 is substantially completely filled.

Preferably, the hole comprising vent 42 is sufficiently small that only a very small quantity of water will pass therethrough when chamber 38 is filled. A hole having a diameter of one thirty-second of an inch (1/32") has been found acceptacle for this purpose. The little bit of water which does pass through the hole 42 and eventually drips down into the trough 14 has been found not to disturb the visual effect created by the display device 10. If desired, a vent with a float valve could be used to vent chamber 38 with the float valve serving to close the vent for preventing the escape of water when the chamber 38 is filled. However, this is not presently preferred as it results in little, if any, enhancement of the visual effect, and its use would require increased maintenance.

As motor 46 rotates, the eccentric 52 imparts a wobble to the motor 46 which is accommodated by the vibration mounting 60. It will be apparent that this wobble is transmitted to housing 30 via the rigid brackets 48. As a consequence of this wobble, one droplet of water passes through each aperture 44 for each rotation of the shaft 50. Further, the droplets do not pass out of the apertures 44 at the same time. Rather, during each rotation of the shaft 50, the droplets pass through the apertures 44 in sequence, that is, with each successive droplet passing through its aperture 44 slightly after the preceding droplet. As a result, the descending droplets form a generally helical pattern (FIG. 1) as they fall into trough 14.

It will be apparent that to achieve the desired effect, the diameter of the apertures 44 must be sufficiently large to permit droplets of water to pass therethrough but not so large that flow of water through the apertures 44 is continuous. Apertures 44 having a diameter of about one thirty-second of an inch are presently preferred. Also, I have determined that the ability to achieve the desired visual effect is facilitated when the rubber discs 57 are used, as they serve to smooth out the wobble imparted to head 12 by rotation of eccentric 52.

Because the droplets passing through each aperture 44 are substantially equally spaced, and because one droplet passes through each aperture 44 for each rotation of shaft 50, when the descending water droplets are strobed at a rate substantially equal to the rotation rate of motor 46, the droplets appear motionless. The resulting visual effect is that of a helix comprised of water droplets suspended in space. When the preferred synchronous motor having a motor speed of 1800 rpm is used, the strobe rate should be 1800 cycles per minute if the droplets are to appear motionless. Of course, the droplets will also appear motionless if the strobe rate is an exact multiple of the motor speed. However, the effect is best when the strobe rate is equal to the motor speed.

If the strobe rate is decreased or increased relative to the motor speed, the helical pattern will appear to rise or fall, respectively. I have found, however, that if the strobe rate is varied too greatly relative to the motor speed, the resulting visual effect is diminished. Therefore, when the preferred synchronous motor having a motor speed of 1800 rpm's is used, I prefer to confine the strobe rate to the range of about 1000 cpm to about 5400 cpm. If desired, the descending droplets may be illuminated by multiple strobes. The resulting visual effect may be further enhanced if the strobes are different colors. The resulting visual effect is still further enhanced when the individual droplets are well defined. It will be apparent that the definition of the droplets is dependent on a variety of factors including the viscosity of the liquid, the pressure in chamber 38, the size of the apertures 44 and the vibration rate, one or more of which may be varied to achieve the desired definition.

As already noted, controller 22 serves to vary the strobe rate in response to audio input signals. It will be apparent however, that the device 10 could be utilized without the controller 22 or with some other form of control for varying the strobe rate such as, for example, a preprogrammed controller. Another possibility is the use of a proximity controller for varying the strobe rate in response to changes in the distance between the strobe unit and the observer. Still another possibility is the use of a controller which varies the strobe rate in response to changing temperature conditions. If such a controller is used, it should be sufficiently sensitive to detect variations in temperature occasioned by body heat. The use of the controller 22 is preferred, however, since it permits an observer to cause the helical pattern to rise, fall, or remain motionless by simply creating a suitable audio signal as by speaking, clapping, etc.

Figure 6:
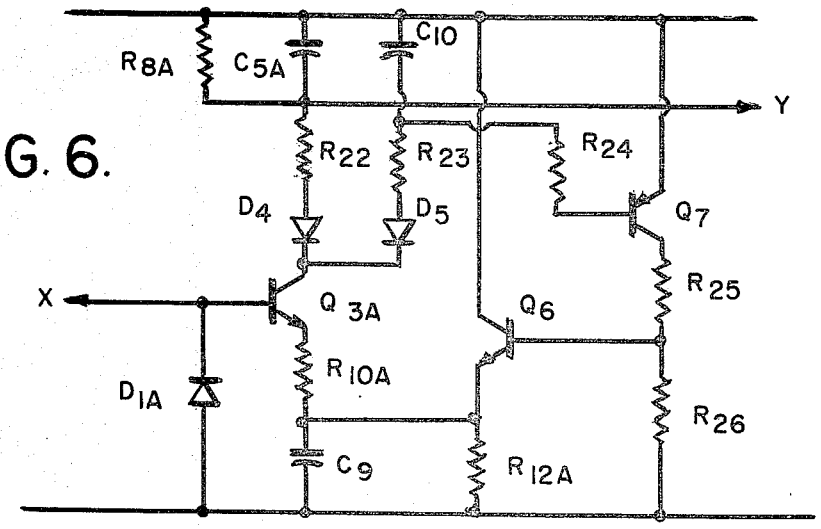
FIG. 6 is a schematic representation of a circuit suitable for incorporation in the controller circuit of FIG. 4 for gradually reducing the sensitivity thereof.

In some applications, as where the device 10 is used as an addition to a symphony performance, the amplitude of the audio input to the controller 22 may set the strobe rate at its maximum for an extended period of time. If this occurs, the helical pattern will continuously move in one direction. Since it is deemed desirable to have the helical pattern change directions intermittently, I have designed the circuit illustrated in FIG. 6 which gradually reduces the sensitivity of the controller 22 when the strobe rate is at its maximum whereby a higher and higher audio amplitude will be required to maintain the maximum strobe rate. The circuit of FIG. 6 is incorporated in the circuit for the controller 22 illustrated in FIG. 4 by simply connecting the terminals marked X and Y in FIG. 6 to the corresponding terminals in FIG. 4. The preferred circuit components for the circuit illustrated in FIG. 6 are:

| Component | Value or Manufacturer's Designation |
|---|---|
| C5A | 2.0uf, 25v |
| C9 | 100uf, 6v |
| C10 | 50uf, 15v |
| D1A, D4, D5 | 1N682 |
| Q3A | 2N2923 |
| Q6 | 2N1306 |
| Q7 | 2N3905 |
| R8A | 240K |
| R10A | 100 |
| R12A | |
| R22 | 2.7K |
| R23 | 10K |
| R24 | 220K |
| R25 | 5.6K |
| R26 | 6.8K |

Based on the above description of the presently preferred display device according to the present invention, those skilled in the art will appreciate that certain changes and modifications may be made therein without departing from the spirit and scope of the invention. For example, rather than employing a submersible pump to recirculate water descending from head 12 into trough 14, the head 12 could be connected to an "endless" supply of water, such as a water faucet, and water in trough 14 could be drained. Also, means for vibrating the head 12 other than weighted member 52 may be used. For example, electromagnetic vibration devices such as those found in acoustic vibrators or speakers are suitable for incorporation in the display device of the present invention. It will also be apparent from the above description that housing 30 may assume other shapes, such as a triangular or square shape. Since these as well as other modifications and changes are intended to be within the scope of the present invention, the above description should be construed as illustrative and not in the limiting sense, the scope of the invention being defined by the following claims.

I claim:

1. A head for incorporation in a strobed liquid display comprising:

a housing defining a chamber, said housing having an inlet opening therein suitable for connection to a liquid supply for filling said chamber with liquid, said housing including a top wall having a vent, a substantially horizontally oriented bottom wall having a plurality of apertures spaced from and distributed about the center thereof for accommodating the outflow of liquid droplets from said chamber, and a side wall extending between said top and bottom walls; and vibrating means rigidly connected to said housing for imparting a periodic wobble thereto for dispensing said droplets from said apertures in sequential fashion with substantially uniform spacing between successive droplets dispensed through each aperture, whereby said dispensed droplets substantially define a helix.

2. The head according to claim 1, wherein said housing is substantially disc-shaped and said apertures are spaced about the periphery of said bottom wall.

3. The head according to claims 1 or 2, wherein said vibrating means comprises:

a shaft; motor means for rotating said shaft; a weighted member secured to said shaft with its center of gravity displaced from the axis of said shaft; means for securing said motor means to said housing; and means for securing said motor means to a stationary support for accommodating movement of said housing and said vibrating means relative to said support.

4. The head according to claim 3, wherein said motor means comprises a synchronous motor and said means for securing said motor means to said support comprises a vibration mounting.

5. The head according to claim 4, wherein said synchronous motor has a rotation speed of about 1800 rotations per minute.

6. The head according to claim 3, wherein said apertures have a diameter of about one thirty-second of an inch.

7. The head according to claim 3, wherein said vent comprises an opening having a diameter of about one thirty-second of an inch.

8. A display device comprising:

a housing defining a chamber, said housing having an inlet opening therein suitable for connection to a liqud supply for filling said chamber with liquid, said housing including a top wall having a vent, a substantially horizontally oriented bottom wall having a plurality of apertures spaced from and distributed about the center thereof for accommodating the outflow of liquid droplets from said chamber, and a side wall extending between said top and bottom walls;

vibrating means rigidly connected to said housing for imparting a periodic wobble thereto for dispensing said droplets from said apertures in sequential fashion with substantially uniform spacing between successive droplets dispensed through each aperture, whereby said dispensed droplets substantially define a helix; and a strobe directed in the vicinity of the liquid outflow from said chamber.

9. The display device according to claim 8, further comprising a controller for varying the rate of said strobe in response to an audio input signal.

10. The display device according to claim 9, wherein the strobe rate varies in response to the magnitude of the audio input signal.

11. The display device according to claim 10, and further comprising means for gradually reducing the sensitivity of the controller.

12. The display device according to claim 8, wherein the rate of said strobe is within the range of about 1000 cycles per minute to about 3600 cycles per minute.

13. The display device according to claim 12, wherein the rate of said strobe is about 1800 cycles per minute.

14. The display device according to claim 8, wherein said housing is substantially disc-shaped and said apertures are spaced about the periphery of said bottom wall.

15. The display device according to claims 8 or 14, wherein said vibrating means comprises:

a shaft; motor means for rotating said shaft, a weighted member secured to said shaft with its center of gravity displaced from the axis of said shaft; means for securing said motor means to said housing; and means for securing said motor means to a stationary support for accommodating movement of said housing and said vibrating means relative to said support.

16. The head according to claim 15, wherein said motor means comprises a synchronous motor and said means for securing said motor means to said support comprises a vibration mounting.

17. The display device according to claim 16, wherein said synchronous motor has a rotation speed of about 1800 rotations per minute.

18. The display device according to claim 15, wherein said apertures have a diameter of about one thirty-second of an inch.

19. The display device according to claim 15, wherein said vent comprises an opening having a diameter of about one thirty-second of an inch.

* * * * *